US007475514B2

(12) United States Patent
Rulquin et al.

(10) Patent No.: US 7,475,514 B2
(45) Date of Patent: Jan. 13, 2009

(54) BUILDING STRUCTURE FOLDING AND UNFOLDING UNDER THE EFFECT OF THE WEIGHT OF THE SAME AND ALONG VERTICAL JOINT AXES

(75) Inventors: Denis Rulquin, Remereville (FR); Grégory Rulquin, Ligneville (FR)

(73) Assignees: Sarl Locaboxe, Saulxures les Nancy (FR); Fabian Rulquin, Remereville (FR)

( * ) Notice: Subject to any disclaimer, the term of this patent is extended or adjusted under 35 U.S.C. 154(b) by 270 days.

(21) Appl. No.: 10/543,485

(22) PCT Filed: Oct. 16, 2003

(86) PCT No.: PCT/FR03/03048

§ 371 (c)(1),
(2), (4) Date: Jul. 26, 2005

(87) PCT Pub. No.: WO2004/076763

PCT Pub. Date: Sep. 10, 2004

(65) Prior Publication Data

US 2006/0248809 A1 Nov. 9, 2006

(30) Foreign Application Priority Data

Jan. 27, 2003 (FR) ..... 03 00886

(51) Int. Cl.
*E04B 1/344* (2006.01)

(52) U.S. Cl. ..... 52/79.5; 52/71; 52/646; 119/519

(58) Field of Classification Search ..... 52/64, 52/70, 71, 79.5, 646; 446/478; 119/431, 119/474, 498, 499, 519; 220/9.2, 9.3
See application file for complete search history.

(56) References Cited

U.S. PATENT DOCUMENTS

| | | | | | |
|---|---|---|---|---|---|
| 1,043,043 | A | * | 10/1912 | Carter | 454/251 |
| 1,052,960 | A | * | 2/1913 | Rasmussen | 52/64 |
| 1,091,391 | A | * | 3/1914 | Romans | 217/15 |
| 2,098,469 | A | * | 11/1937 | Smith | 52/66 |
| 3,091,816 | A | * | 6/1963 | Wetzel | 108/172 |

(Continued)

FOREIGN PATENT DOCUMENTS

| | | |
|---|---|---|
| EP | 0340073 | 11/1989 |

(Continued)

*Primary Examiner*—Richard E Chilcot, Jr.
*Assistant Examiner*—Bryan Eppes
(74) *Attorney, Agent, or Firm*—Gary M. Cohen

(57) ABSTRACT

A structure that can be folded and unfolded to construct buildings, for example, horse stables, includes frames made from welded profiles and covered with panels having doors, windows or ventilators, covered by a roof. After deployment and installation, the structure forms a parallelepipedal volume with rigid front and rear façades and two folding lateral walls. Each of the lateral walls has a central axis, and joints receiving four rectangular leaves which can be folded accordion-style. The distance between the two central axes remains constant and the structure has two anchoring points on each lateral wall which are positioned on top of the structure and symmetrically relative to the central axis. A lifting beam is used to raise the structure, which folds or unfolds under the influence of the weight of the structure due to forces exerted on cables fixed between the lifting beam and the structure.

16 Claims, 2 Drawing Sheets

U.S. PATENT DOCUMENTS

| | | | | | |
|---|---|---|---|---|---|
| 3,526,066 | A | * | 9/1970 | Gamble et al. | 52/27 |
| 3,550,601 | A | * | 12/1970 | Peters | 135/152 |
| 3,667,800 | A | * | 6/1972 | Cuthbert | 296/173 |
| 3,752,349 | A | * | 8/1973 | Rana | 220/6 |
| 3,778,100 | A | * | 12/1973 | Dillard | 296/164 |
| 3,984,949 | A | * | 10/1976 | Wahlquist | 52/70 |
| 4,027,912 | A | * | 6/1977 | Pacca | 296/160 |
| 4,074,475 | A | * | 2/1978 | Wahlquist | 52/70 |
| 4,166,343 | A | * | 9/1979 | O'Brian et al. | 52/66 |
| 4,493,118 | A | | 1/1985 | Braxton | |
| 4,580,776 | A | * | 4/1986 | Burkinshaw | 52/7 |
| 4,741,133 | A | * | 5/1988 | Kutzner | 52/79.5 |
| 4,829,726 | A | * | 5/1989 | de Potter d'Indoye | 52/66 |
| 4,989,379 | A | * | 2/1991 | Suzuki | 52/66 |
| 5,214,885 | A | * | 6/1993 | Maas et al. | 52/71 |
| 5,331,777 | A | * | 7/1994 | Chi-Yuan | 52/64 |
| 5,549,073 | A | * | 8/1996 | Askins et al. | 119/474 |
| 5,626,098 | A | * | 5/1997 | Askins et al. | 119/474 |
| 5,661,930 | A | * | 9/1997 | Porter | 52/64 |
| 6,434,895 | B1 | * | 8/2002 | Hosterman et al. | 52/143 |
| 6,550,491 | B1 | * | 4/2003 | Bixler et al. | 135/145 |
| 6,581,345 | B2 | * | 6/2003 | Goldsmith et al. | 52/243.1 |
| 6,598,355 | B2 | * | 7/2003 | Owens | 52/71 |
| 7,021,242 | B2 | * | 4/2006 | Axelrod | 119/496 |
| 2001/0037613 | A1 | * | 11/2001 | Owens | 52/71 |
| 2005/0229866 | A1 | * | 10/2005 | Simpson et al. | 119/499 |
| 2006/0248809 | A1 | * | 11/2006 | Rulquin et al. | 52/79.5 |

FOREIGN PATENT DOCUMENTS

| | | |
|---|---|---|
| FR | 2826385 | 12/2002 |
| GB | 2291075 | 1/1996 |

* cited by examiner

BUILDING STRUCTURE FOLDING AND UNFOLDING UNDER THE EFFECT OF THE WEIGHT OF THE SAME AND ALONG VERTICAL JOINT AXES

BACKGROUND OF THE INVENTION

The present invention relates to a building structure that can be folded and unfolded, one example being a building structure that can be used for housing horses during horse shows.

Known structures for such purposes, for example, the structure disclosed by FR 2 826 385, are lightweight and foldable, but require several folding maneuvers and mechanisms for locking such structures in their unfolded position to prevent the top part from folding in on the occupants.

The object to be achieved is, therefore, to produce stables, such as stables for housing horses during a show, which can be folded and unfolded without the need for complicated and/or expensive mechanisms.

SUMMARY OF THE INVENTION

This object is achieved in accordance with the present invention by providing a structure that can be folded and unfolded, for the construction of a building enclosure. A structure that can be used for such purposes, including but not limited to horse stables, includes a plurality of frames made from welded sections and covered with panels or sheets. The frames can include desired doors, windows or ventilators, and the assembly can be covered by a roof to complete the desired structure.

After deployment and installation of the structure, a parallelepipedal volume is produced having a rigid front façade and rear façade, and two folding lateral walls. Each of the lateral walls includes joints located on one central vertical joint axis and on two secondary vertical joint axes provided on either side of the central axis. As a result, each lateral wall is comprised of four rectangular leaves, each of which has the same height, and which can be folded accordion-style. The distance between the two central axes of the lateral walls remains constant, and the structure has two fixing or attachment points on each of the lateral walls which are positioned on top of the structure and which are symmetrical relative to the central axis.

The present invention is further directed to a method of folding and unfolding the foregoing structure. To this end, a lifting bar is used to raise the structure and the structure is caused to fold or unfold under the effect of its own weight due to tensile forces exerted by the weight placed on cables attached between the lifting bar and the structure.

The invention will be more clearly understood with reference to the description provided hereafter, with reference to the following drawings.

DETAILED DESCRIPTION OF PREFERRED EMBODIMENTS

Figure 1:
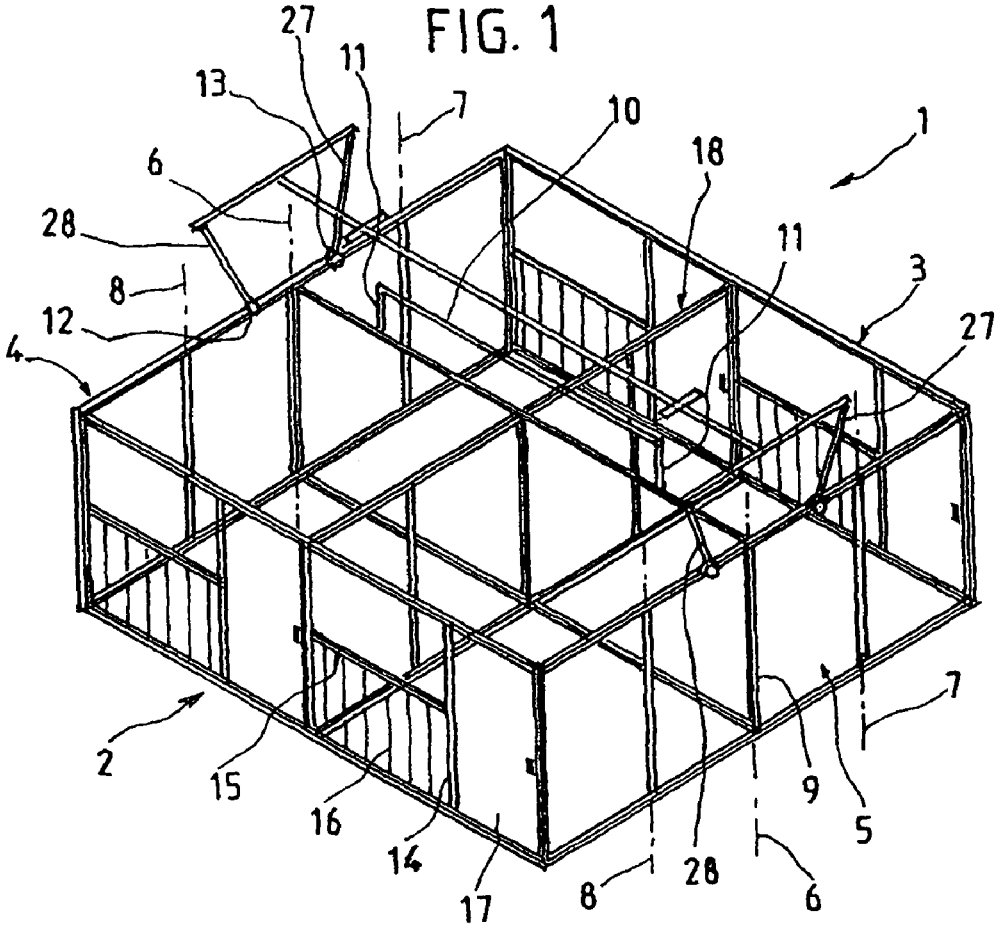
FIG. 1 is an isometric view of a structure produced in accordance with the present invention.
Figure 2:
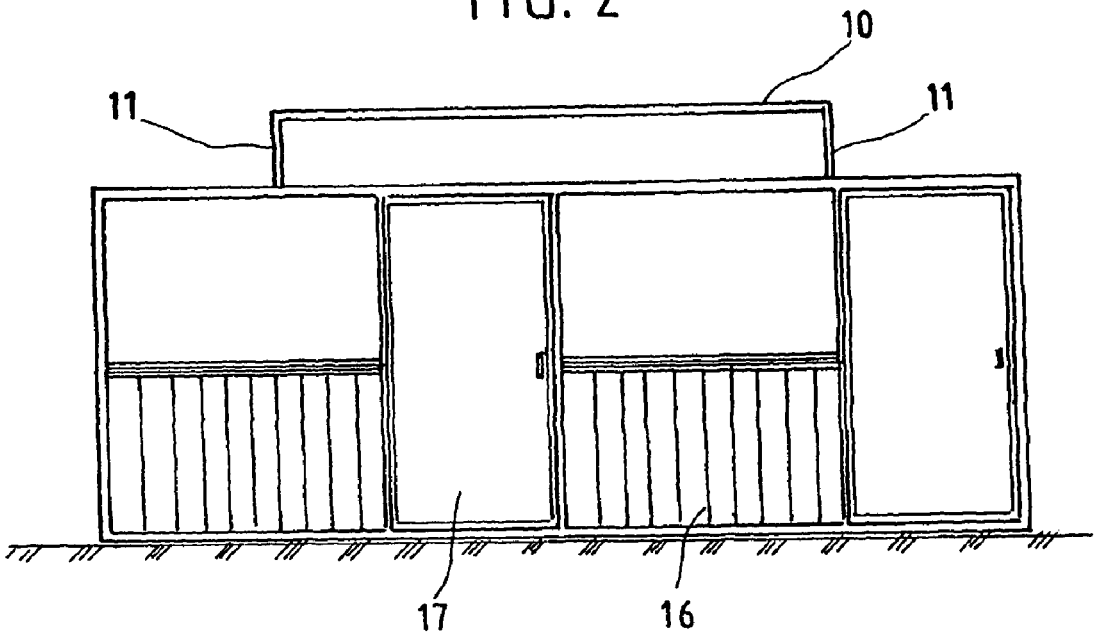
FIG. 2 is a side view of one of the façades of the structure shown in FIG. 1.

After being deployed and installed, the folding structure (1) of the present invention establishes a parallelepipedal volume defined by a non-folding front façade (2), a non-folding rear façade (3), and two folding lateral façades (4, 5). Each of the lateral walls (4, 5) includes a plurality of joints (19) provided on a central vertical axis (6) and on two secondary vertical axes (7, 8) located on either side of the central axis (6). As a result, each lateral wall is comprised of four rectangular leaves (20) which can be folded accordion-style. The rectangular leaves (20) have the same height and are preferably, but not necessarily equal in width.

To allow the structure (1) to fold, the distance between the two central axes (6) must remain constant and rigid. For this purpose, the structure includes a rigid rectangular central frame (9). The top of the central frame (9) is reinforced by a stiffening bar (10) which runs parallel to and above the central frame (9) and which is fixed to the central frame (9) by two legs (11). To further allow for folding, the structure includes two fixing or attachment points (12, 13) on each of the lateral walls (4, 5) which are positioned on top of the structure and which are symmetrical relative to the central axis (6). The attachment points (12, 13) can, for example, be rings for attaching cables or chains.

Preferably, and to keep the structure lightweight, the structure is comprised of frames made, for example, from welded sections. Each of the welded sections can include additional welded bars, for example, the bars (14, 15), for attaching doors, partitions and/or windows. Desired covering elements (sheets of metal or plastic, lightweight rigid panels (16), doors (17) or the like) are attached to the frames to finish off the stables, and a roof (not shown) is laid over the top of the structure.

Depending on where the internal intermediate partitions are placed, the stables can be divided into several boxes. An intermediate partition, such as the partition (18), can be placed parallel to the lateral walls (4, 5), and can also be folded accordion-style.

Operations for folding and unfolding the structure will now be described. Such operations are performed using a beam (21) forming a lifting bar that can be suspended from the arm of a crane (not shown). The beam (21) is longer than the central frame (9) and has two intermediate attachment points (22, 23) provided at a set distance from the ends of the beam. A smaller beam (24) is provided at each end of the beam (21), perpendicular to the beam (21). Each end of the smaller beam (24) includes an attachment point (25, 26).

Figure 3:
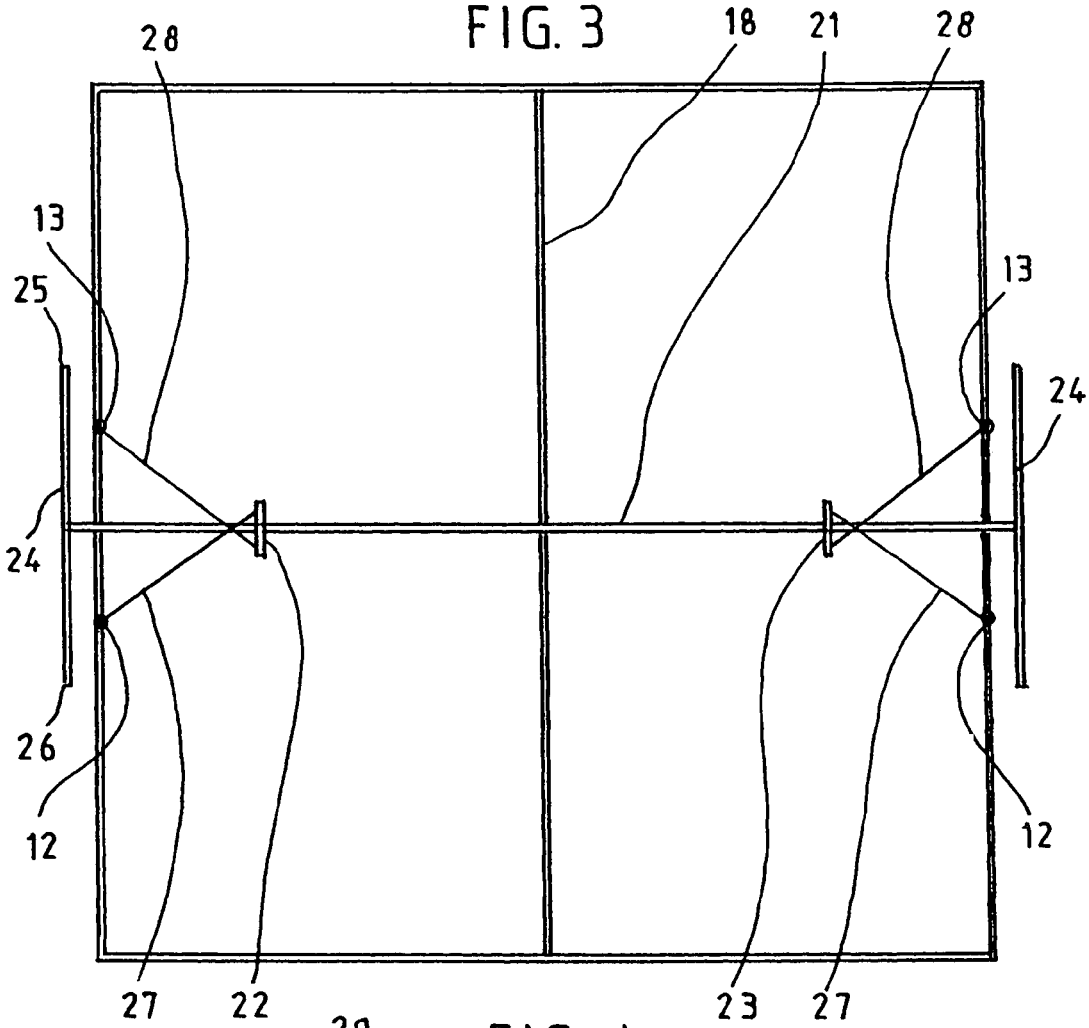
FIG. 3 is a top plan view of the structure shown in FIG. 1 in the unfolded position.

To fold the structure, two cables (27, 28) (or chains) coupled with the lifting bar (21) are attached between the attachment points (12, 13) of a lateral wall and the closest intermediate attachment point (22 or 23). The same is done for the other lateral wall and the corresponding intermediate attachment point (see FIG. 3, showing the position of the cables (27, 28) before folding).

Figure 4:
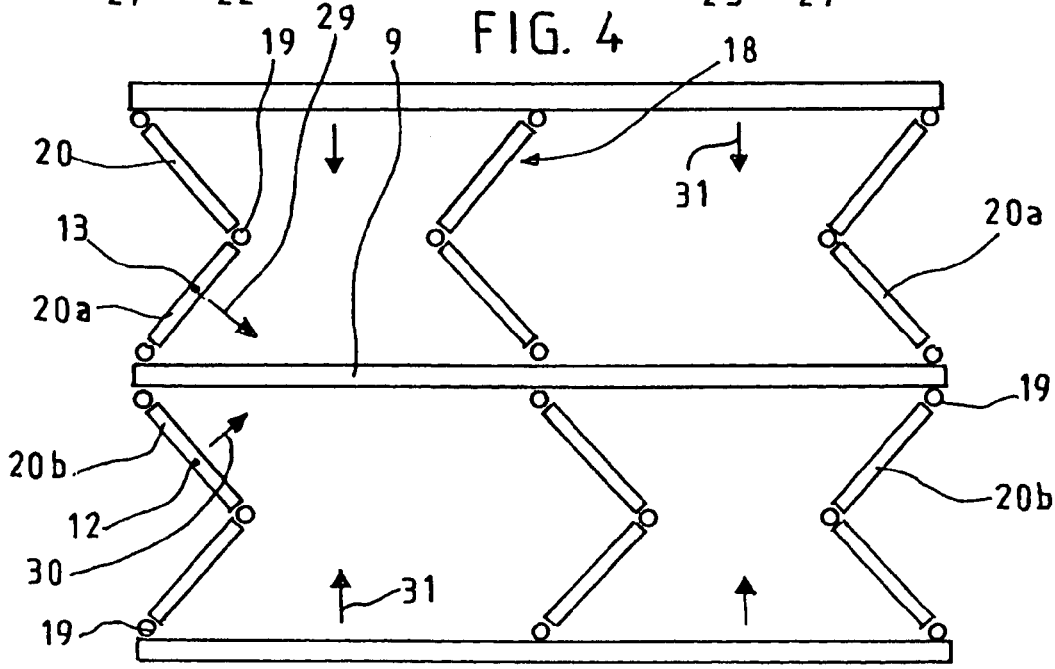
FIG. 4 is a top plan view of the structure shown in FIG. 1 as it is being folded.

The lifting bar is then raised, with the result that the weight of the structure generates tensile force components (29, 30) on the cables (27, 28). This then causes the leaves (20*a*, 20*b*) jointed along the central axis (6) to pivot in the direction of the central frame (9). The lateral walls (4, 5) and the intermediate walls (18) then fold, accordion-style, and the front and rear façades (2, 3) move toward the central frame (9) in the direction of the arrows 31 shown in FIG. 4. Preferably, to ensure that the façades (2, 3) come to be pressed against a central wall, if there is one, or against one another if there is not, the cables (27, 28) are crossed at each attachment point (22, 23), as shown in FIG. 3. Once folded, a compact, neat structure is obtained.

To unfold the structure, the cables of the lifting bar are attached between the attachment points (12, 13) on the leaves (20), which are at that point folded, and the attachment points (25, 26) on the ends of the smaller beams (24), as is shown in FIG. 1. By raising the lifting bar (21), the tensile forces of the cables (27, 28) under the effect of the weight of the structure causes the leaves (20*a*, 20*b*) to rotate. As a result, the leaves (20*a*, 20*b*) are caused to move away from the frame (9), causing the lateral walls (4, 5) to unfold (see FIG. 1, which shows the position of the cables after the structure has been unfolded).

The connections (27, 28) can be cables, chains, rigid metal or non-metal rods, etc., and can have variable lengths depending on the locations selected for the attachment points (12, 13, 22, 23, 25 and 26).

The structure of the present invention achieves its objectives in that it is easy to fold and unfold, the components used to produce the structure are simple, inexpensive and effective, and its operating principles can be extended to other uses, for example, fair stands, emergency shelters for accident victims, etc.

The invention claimed is:

1. A structure that can be folded and unfolded to construct a building, including horse stables, having frames made from welded sections and covered with materials capable of receiving mechanical structures including doors, windows and ventilators, and capable of being covered by a roof, wherein the structure has a weight and comprises:

a rigid front wall, a rigid rear wall and two folding lateral walls connecting the front wall and the rear wall to form a parallelepipedal volume after deployment and installation of the structure;

wherein each of the lateral walls includes a plurality of joints located on a central vertical joint axis and on two secondary vertical joint axes provided on either side of the central joint axis, and four rectangular leaves having the same height and which can be folded accordion-style;

wherein the distance between the central joint axis associated with each of the lateral walls remains constant; and wherein the structure includes structure attachment points which support the weight of the structure, wherein two of the structure attachment points are located on each of the lateral walls, and wherein the two structure attachment points are positioned on top portions of the structure at locations which are symmetrical relative to the central joint axis;

in combination with a beam coupled with the structure attachment points on the lateral walls, for automatically folding and unfolding the structure responsive to the weight of the structure.

2. The structure of claim 1 which further includes at least one intermediate partition which can be folded accordion-style.

3. The structure of claim 1 wherein the frames further include welded bars for receiving the mechanical structures.

4. The structure of claim 1 wherein the covering materials are attached to the frames to enclose the structure.

5. The structure of claim 4 wherein the covering materials are sheets of material.

6. The structure of claim 4 wherein the covering materials are lightweight rigid panels.

7. The structure of claim 1 wherein the structure attachment points are coupled with two of the leaves adjacent to and on opposing sides of the central joint axis.

8. The structure of claim 1 which further includes a rigid central frame separating the central joint axis associated with each of the lateral walls, for maintaining the distance between the central joint axis associated with each of the lateral walls constant.

9. The structure of claim 1 wherein the beam further includes a pair of beam attachment points spaced from ends of the beam and connected to the nearest adjacent structure attachment points for automatically folding the structure.

10. The structure of claim 9 wherein a pair of connections attach the beam attachment points and the structure attachment points, and wherein the connections are crossed at the beam attachment points.

11. The structure of claim 9 wherein the beam further includes a secondary beam perpendicular to the beam and having secondary beam attachment points located at ends of the secondary beam, and wherein the secondary beam attachment points are connected to the nearest adjacent structure attachment points for automatically unfolding the structure.

12. A method for folding and unfolding the structure of claim 1, comprising the steps of:

coupling the beam with the structure attachment points on the lateral walls; and lifting the beam and the structure, and automatically folding and unfolding the structure responsive to the weight of the structure.

13. The method of claim 12 wherein the folding and unfolding is responsive to tensile forces exerted by the weight of the structure on connections attached between the beam and the structure.

14. The method of claim 13 wherein the beam further includes a pair of beam attachment points spaced from ends of the beam, and wherein the method further includes the step of attaching the beam attachment points to the nearest adjacent structure attachment points for automatically folding the structure.

15. The method of claim 14 which further includes the step of crossing the connections attaching the beam attachment points and the structure attachment points.

16. The method of claim 13 wherein the beam further includes a secondary beam perpendicular to the beam and having secondary beam attachment points located at ends of the secondary beam, and wherein the method further includes the step of attaching the secondary beam attachment points to the nearest adjacent structure attachment points for automatically unfolding the structure.

* * * * *